United States Patent [19]

Bayer

[11] Patent Number: 4,559,739

[45] Date of Patent: Dec. 24, 1985

[54] STABILIZED PIVOTABLE WINDOW

[75] Inventor: Michael S. Bayer, South Euclid, Ohio

[73] Assignee: Thermal-Barrier Products, Inc., Bedford, Ohio

[21] Appl. No.: 555,684

[22] Filed: Nov. 28, 1983

[51] Int. Cl.[4] ..... E05D 15/22

[52] U.S. Cl. ..... 49/177

[58] Field of Search ..... 49/177, 174, 175, 185, 49/149, 158, 161, 162

[56] References Cited

U.S. PATENT DOCUMENTS

| | | | |
|---|---|---|---|
| 3,041,680 | 7/1962 | Gurniak | 49/177 X |
| 4,144,674 | 3/1979 | Dovman | 49/175 X |
| 4,222,201 | 9/1980 | Yanessa | 49/174 X |
| 4,337,597 | 7/1982 | Struckmeyer | 49/174 X |

*Primary Examiner*—Philip C. Kannan

*Attorney, Agent, or Firm*—Renner, Otto, Boisselle & Lyon

[57] ABSTRACT

A pivotable and slidable window assembly includes one or more sashes slidable in parallel, coplanar horizontal tracks. Each sash carries a pair of pivot members extending in opposite directions from the sash to define a pivot axis for swinging the sash out of its usual sliding plane for cleaning or the like of both sides of the sash. Each pivot member is slidably received in a respective one of the tracks, and each includes a foot extending in the plane of sliding movement of the sash and perpendicular to the pivot axis. Each track includes an opening to receive the foot of a respective pivot member when the sash is pivoted for cleaning. Upon pivoting of the sash and movement of the feet into the respective openings, contact between the feet and the openings stabilizes the sash preventing further and unwanted sliding of the sash in the tracks. Thus the sash cannot twist catercorner with respect to the tracks and is prevented from falling out while pivoted.

18 Claims, 6 Drawing Figures

STABILIZED PIVOTABLE WINDOW

FIELD OF THE INVENTION

The present invention relates to window assemblies, and in particular to sliding window assemblies which may be pivoted out of their plane of normal sliding for cleaning purposes.

BACKGROUND OF THE INVENTION

The prior art includes sliding windows with sashes which slide between opened and closed positions in parallel tracks. Generally, such windows include two sashes which slide in parallel, offset tracks. Weather-stripping seals the spaces between the sashes and between the sashes and tracks. Although traditional window assemblies (including sashes and tracks) have been made of wood, modern manufacturing techniques and materials have made it possible to manufacture these components from metal or plastics, or a combination, and such combined materials have thermal, esthetic and economic advantages.

Additionally, there have been windows of the sliding type which have mechanisms allowing the window sash to pivot about an axis so that the sash may be washed on both sides from within the building in which it is installed. Windows of this type have been both vertically double hung windows and horizontally sliding windows. The pivot mechanisms have included movable pins mounted on one edge of the sash which may be extended upward and downward to engage holes in the track and to form the axis about which the sash may be pivoted. At the opposite vertical edge are releasable track engaging members which may be withdrawn from the track to allow the sash to pivot.

Although such windows have worked, special steps have been required to maintain the sash steady when it is pivoted out of its usual sliding plane. For example, U.S. Pat. No. 4,222,201 shows such a window assembly, and it requires that spring loaded pins be released so that the springs push the pins into circular passages formed in the tracks. Then the sash may be pivoted. When window cleaning is complete, the pins must be retracted against the spring bias to free the pins from the circular passages, and locknuts must be secured to hold the pins in the retracted position for ordinary sliding. Not only does this mechanism require moving parts which may over time corrode or bind, but the pivoting procedure is complicated, and there may be problems with the sash not being adequately stable when pivoted open.

SUMMARY OF THE INVENTION

The present invention overcomes the difficulties of the prior art window assemblies by providing an improved sliding and pivoting mechanism for use in a sliding window which includes at least one, and preferably two, and possibly more, sashes which slide in a window frame. According to the present invention a window of the double sliding sash type has a pair of pivot members which extend in opposite directions from one edge of the sash. Each pivot member includes a first portion or leg by which it is fastened to the edge of the sash, and terminates in a short foot. The foot extends normal to the first portion and in the plane of the sash. A pair of manually releasable pins extends in opposite directions from the side of the sash opposite from the pivot members. The pivot feet and releasable pins support the sash in the track for sliding in the usual horizontal direction to open or close the window.

To pivot the sash, as for washing, the sash is first slid in the track until the feet at the top and bottom of the one side of the sash are aligned with slots or openings in the sidewalls of the track. Then the releasable pins on the other side of the sash are manually retracted and the sash is pivoted out of its usual plane of motion into the interior of the building so that both sides of the sash are simultaneously readily accessible. The slots in the sidewalls of the track accommodate the projecting ends of the feet as the sash pivots and prevent the sash from twisting diagonally and/or falling out when it is pivoted for washing.

The feet have a relatively broad contact area with the track during sliding movement, so no additional bushing or bearing is required even where the foot is made of metal and the track is extruded from polyvinyl chloride or other rigid vinyl or like material that has adequate strength and durability characteristics. Further, because the feet are permanently fixed to the sash, pivoting movement is more easily accomplished than with windows where the pins about which the sash pivots must be manually adjusted before the sash can be pivoted for cleaning.

In addition, the tracks of the window are profiled to facilitate easy pivoting of the sash back into its usual position. Specifically there are two different track profiles used. The first of the tracks readily allows the feet to slide in it; the other track blocks entrance of the feet. The openings which provide clearance for the feet as the sash pivots are formed in the first track section which is formed with heavy sectioned walls so there is adequate strength to support the pivoting of the sash. The second track section may be made of thinner material, and has inclined surfaces against which the manually releasable pins slide as the sash is returned to its normal position after cleaning. By selecting the length of the second track to be just slightly longer than the width of the one of the sashes, the track will prevent this sash from being opened too far and causing damage, e.g. to the handle of the other operating sash, etc., because the feet will not slide into such other track.

The invention, then, comprises the features hereinafter particularly pointed out and distinctly claimed in the claims. The following specification, taken together with the appended drawings, describes but a few of the various ways in which the invention may be carried out.

DESCRIPTION OF PREFERRED EMBODIMENTS

Figure 1:
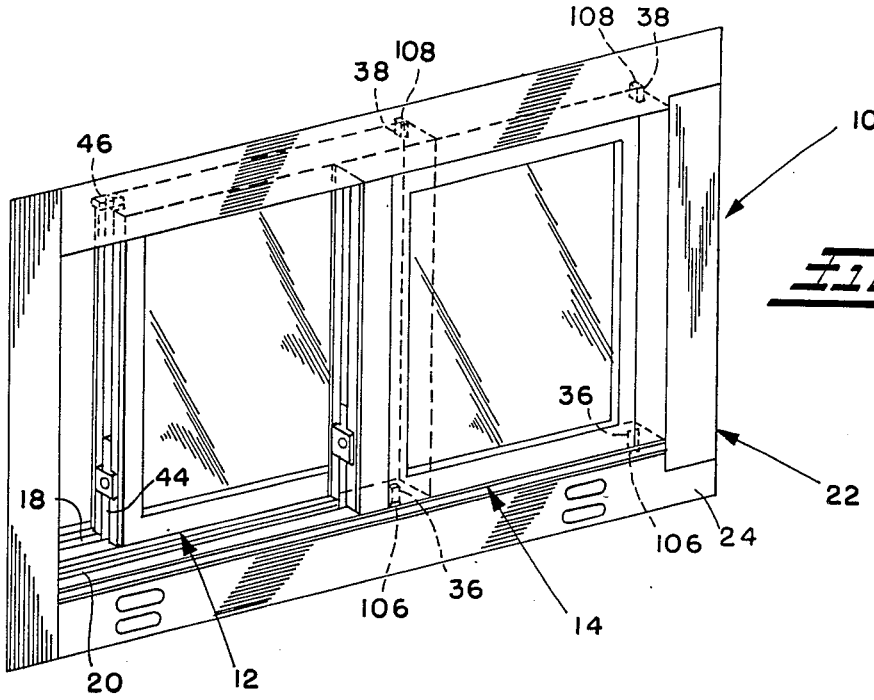
FIG. 1 is a perspective illustration of a horizontally sliding window embodying the features of the present invention and viewed from the outside.
Figure 2:
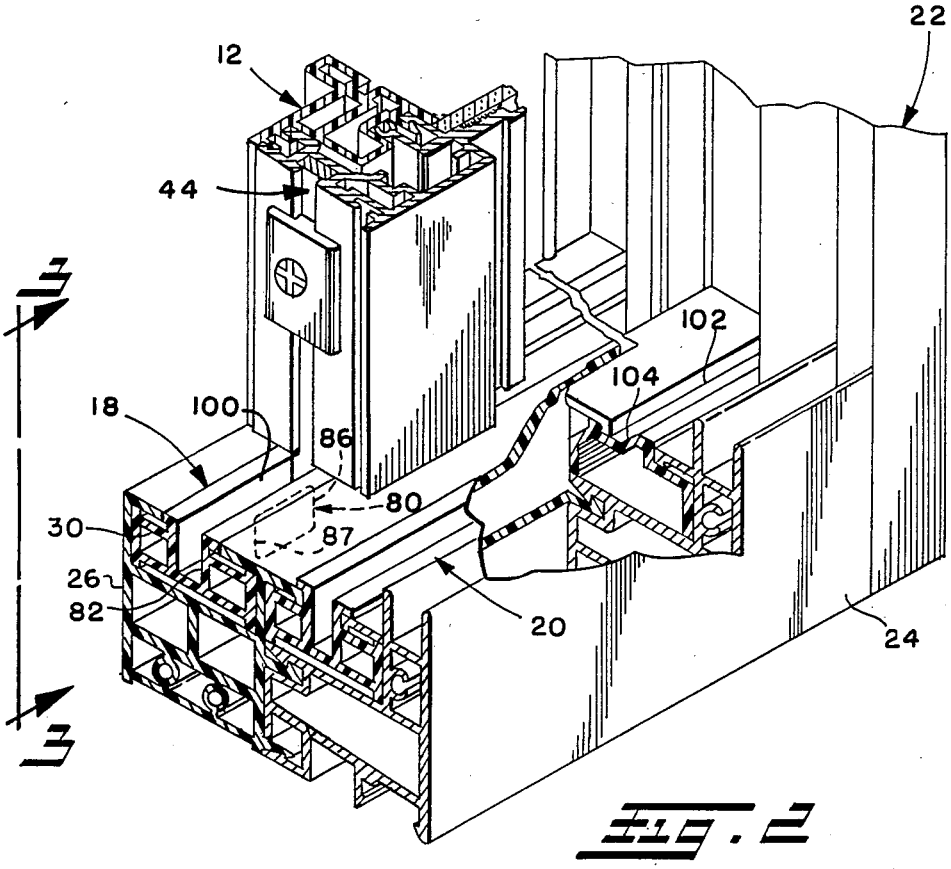
FIG. 2 is an enlarged partially sectioned view of a portion of the window of FIG. 1, and also viewed from the exterior of the window.
Figure 3:
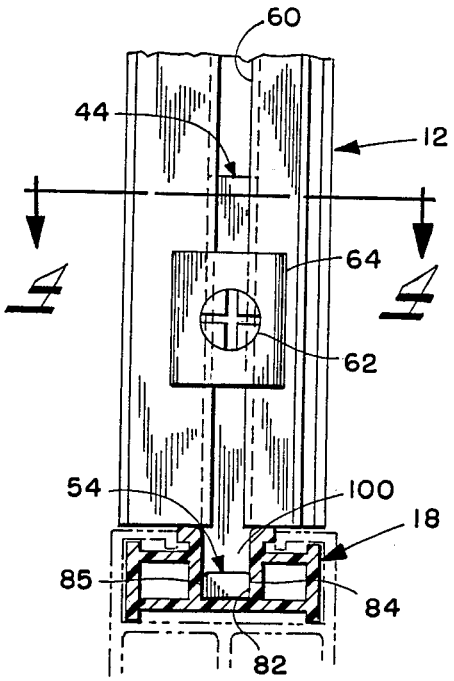
FIG. 3 is a view looking in the direction of arrows 3—3 of FIG. 2.

The window assembly 10 (FIG. 1) includes two sashes 12 and 14 which are horizontally slidable in tracks 18 and 20 (FIG. 2). As illustrated in FIG. 1, the sashes 12 and 14 slide horizontally, with the sash 14 mounted outside of the sash 12. The description which follows proceeds with respect to the window assembly as oriented in FIG. 1. However, it will be clear to those of ordinary skill in the art that the present invention could be embodied in other types of windows to achieve rotation of the entire window assembly approximately 90° from a closed condition. In the description that follows, the words "above", "below", "inside" and "outside" as well as "right" and "left" are used with respect to the orientation of the window assembly 10 shown in FIG. 1. This however is not intended to be limiting in any way and is merely for convenience of description.

The window assembly 10 includes tracks 18 and 20 which are mounted in a window frame 22. The window frame 22 may be formed either of metal or PVC extrusions or other similar extrusions, and in preferred embodiments of the present invention the exterior facing portion 24 of the frame 22 is formed from an aluminum extrusion while the interior facing portion 26 of the frame 22 is made of vinyl. This construction provides a thermal barrier to reduce heat loss. In any event, and whether the frame 22 is formed of metal, vinyl, plastic or even wood, the frame includes recesses 30 and 32 which mount and support the tracks 18 and 20, respectively. The recesses 30 and 32 are formed in the lower, horizontal member of the frame 22, and an identical pair of recesses (not shown) are formed in the upper member of the frame.

Figure 6:
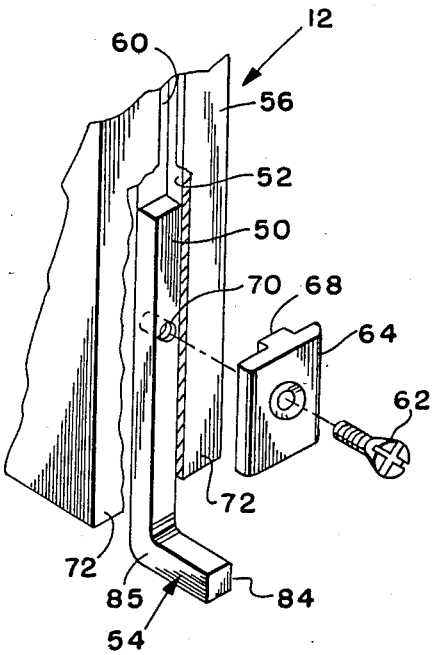
FIG. 6 is a partially sectioned and exploded view of a portion of the pivot mechanism of the window assembly of FIG. 1.

Each sash includes means for guiding its sliding movement in the frame 22. As illustrated in FIG. 1, there are two spring-loaded guide pins 36 and 38 which project downwardly and upwardly, respectively, from the rail of the sash 12 into the track 18. The pins 36 and 38 are essentially conventional, being spring biased to their extended positions and being retractable by means of appropriate buttons for purposes which will become clear from the discusion which follows. At the lefthand end of sash 14 there are a pair of identical pivot members 44 and 46. Inasmuch as the two pivot members are identical, only the pivot member 44 will be described in detail, it being understood that the description applies equally to the pivot member 46. The pivot member 44 (FIG. 6) includes a straight leg portion 50 which extends and fits snugly into a recess 52 formed in the vertical rail on the right side of sash 12. At the lower end portion of the pivot member 44 is a relatively short foot 54 which extends perpendicular to the straight leg portion 50 and in the plane of the glazing of the sash 12. The pivot member 44 is integrally formed from a piece of tooling steel which has a generally rectangular cross section. The width of the pivot member 44 is selected to slide easily within the tracks 18 or 20.

Means are provided for securing the pivot member 44 against unintended vertical movement with respect to the sash 12. In a preferred embodiment, the rail 56 of the sash 12 is formed, like the frame 22, of metal and plastic extrusions which are joined to each other. The recess 52 is formed in the metal portion of the rail 56 and extends its entire vertical length. In addition, the recess 52 is defined by the metal walls of the rail 56 which also define an outwardly opening slot 60. The pivot member 44 is secured in the recess 52 by means of a retaining bolt 62 and positioning and pivot pin locking pad 64. The pad 64 is formed of a relatively hard synthetic material such as a plastic material, e.g. nylon or Celcon. The pad 64 is generally shaped like a rectangular solid with a projecting tab 68 which fits into the slot 60 snugly. The pivot member 44 includes a threaded passage 70 which receives the bolt 62. When the bolt 62 is passed through the pad 64 and tightened into the passage 70, the portions of the pad 64 which extend beyond the projecting tab 68 bear tightly against the outside surface 72 of the rail 56, while the projecting tab 68 prevents rotation of the pad 64. Therefore, by tightening the bolt 62 it is possible to draw the leg portion 50 and the pad 64 toward each other to clamp the pivot member 44 against the walls of the rail 56 and into the desired position in the recess 52.

The foot 54 of the pivot member 44 preferably does not support the sash 12. Rather, a slider/glide pad assembly at all four corners, i.e. both top and bottom of the sash, supports the weight for easy sliding movement. The foot also slides in the track 18 and helps stabilize the side-to-side movement of the window during horizontal movement. Additionally, the corners of the foot 18 are slightly rounded, or at least not sharp, so that theydo not dig into the vinyl extrusion track 18.

The window assembly 10 is designed so that the sashes 12 and 14 not only may slide in a plane defined by the upper and lower tracks in which they slide and parallel to the plane of their glazing for conventional opening and closing of the window assembly, but also the sashes 12 and 14 may individually be pivoted out of their plane of sliding movement so that both sides of the glazing of each sash may be easily cleaned from one side of a wall on which the window assembly is installed. The present invention not only makes pivoting a simple operation, it also stabilzes the sash when pivoted so that it does not twist diagonally in the window frame or fall out of the frame during pivoting movement and while in a pivoted condition. To this end, openings 80 are formed in a vertical sidewall 82 of the track 18. The openings 80 have a vertical dimension the same as or slightly larger than the vertical dimensión of the foot 54 (FIG. 6) of the pivot member 44 and the two openings are in vertical alignment with each other, one being formed in the exterior vertical sidewall of the track 18 and the other in alignment therewith in the track which supports the top of the sash 12.

Figure 5:
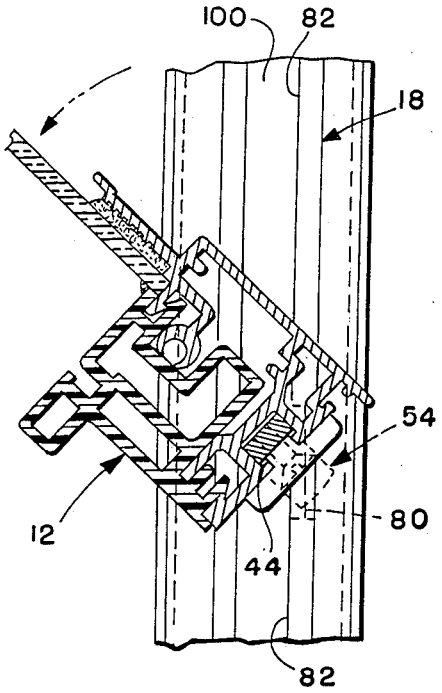
FIG. 5 is a view generally similar to FIG. 4 but showing the window assembly partially pivoted for cleaning.
Figure 4:
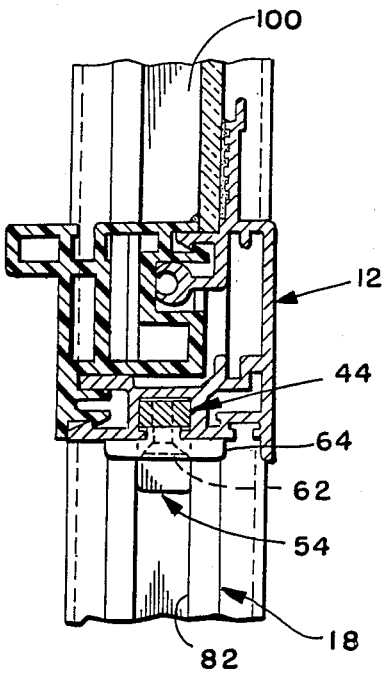
FIG. 4 is a view looking in the direction of arrows 4—4 of FIG. 3.

To pivot the sash 12 inward for cleaning, the sash is first slid along the track 18 until the foot 54 and the foot of the corresponding pivot member 46 extending upward from the top of the sash are in alignment with the respective openings 80 in the tracks in which they slide. Then, the retractable pins 36 and 38 are manually retracted so that they are free of contact with their respective tracks. Thereafter, the edge of the sash 12 from which the pins 36 and 38 extend is pulled inward while the opposite edge of the sash pivots about an axis defined by the leg portions 50 of the pivot members 44 and 46. As the pivot members 44 and 46 rotate, the feet 54 project into the openings 80 as shown in FIG. 5. Of course, if the window had not first been slid into proper alignment with the openings 80, the feet would bind against the sidewall 82 of the respective tracks 18 thereby preventing the window sash from being pivoted into the room while unsecured, i.e., when the feet are not aligned and/or in the respective openings 80.

Moreover, when the sash is properly aligned, and the feet do rotate into and through the openings 80, the feet serve to stabilize the pivoted open window, preventing it from rotating catercorner in the frame and falling out. This is so because the side faces 84 and 85 of the feet 44 engage the ends 86 and 87 of the openings 80. This prevents twisting of the sash while it is pivoted out of its usual plane of sliding movement and thus assures that the pivoting will be only about the axis defined by the pivot members 49 and 46.

In addition, it should be noted that the tracks 18 and 20 may be formed with a change in profile along their axial length which serves to limit the extent to which the sash may be slid in one direction. For example, the lefthand portion (as seen in the exterior view shown in FIG. 1) of the tracks 18 and 20 may have a rectangular slot 100 through which the foot 54 of the pivot member 44 (FIG. 6) slides easily. On the other hand, the righthand portion of the tracks may have a profile with a slot 102 which is narrower than the slot 100. The slot 102 will easily accommodate sliding of the rectractable pins 36 and 38 therethrough, but is too small to allow the foot 54 to enter. By selecting the length of the righthand portion of the tracks 18 and 20 to be slightly longer than the distance between the righthand edge of the frame 22 and the pivot member 44 of the lefthand sash 12, the righthand portion of the track 18 will limit the distance through which the sash may be slid, thereby preventing the sash from being banged into the lefthand edge of the window frame.

Although the description has proceeded with respect to the lower portion of the window frame 22, the upper portion is essentially the same, and the description applies equally thereto. There is, however, one exception. To facilitate pivoting of the sash 14 inward for cleaning both sides of it, the window frame 22 forms an opening which is shorter for the outer sash 14 than for the inner sash 12. The bottom edges of the two sashes are level with each other, however the upper edge of the outer sash 14 is lower than the upper edge of the inner sash 12. In this way, the weatherstripping or the like associated with the outer sash does not contact the top of the window frame as the window is pivoted inward. In addition the openings 80 associated with the track 20 are spaced to the right (as viewed in FIG. 1) of the openings 80 in the track 18. This allows both sashes 12 and 14 to be pivoted simultaneously into the building in which the window assembly 10 is installed.

As a further feature of the present invention, the righthand portion (as seen in FIG. 1) of the tracks 18 and 20 may be provided with inclined or beveled surfaces 104 which slant in a direction to facilitate returning of the windows from their pivoted position to their normal position. To further this end, the pins 36 and 38 may be provided with beveled end surfaces 106 and 108. When pressed against the window frame 22 while pivoting the window back to its normal position, the inclined surface tends to retract the spring-loaded pins. The beveled surfaces on the tracks 18 and 20 further cooperate with the beveled surfaces on the pins 36 and 38 to ease the return of the window sashes to their usual position.

Thus, it will be appreciated that the invention may be used in connection with horizontally sliding windows in which one, two, three or even more sashes can slide generally in a horizontal fashion relative to the window frame. The sliding sash(es) will function in the usual sliding manner to enable opening or closing of the window. However, with the sash moved to the oppropriate position for rotation for cleaning purposes, for example, i.e. with the feet aligned with respective openings in the upper and lower tracks, the buttons may be operated to withdraw the retractable pins and the window may be pivoted about a generally vertical axis. During such pivoting the feet hold the window in place and prevent the same from falling out, as has been described in detail above. More than one window may be pivoted open for cleaning at a time, if desired. After cleaning, for example, the pivoted open window may be moved back into closed position fully aligned with the appropriate tracks and slides for further horizontal sliding movement in usual manner. Therefore, the invention improves efficiency and facility vis-a-vis window cleaning, for example, while also improving the overall safety of operation since the window is held rather securely in place during normal sliding operation, during pivoting, and while pivoted in the open condition.

I claim:

1. A pivotable window assembly including a generally planar sash, parallel tracks extending along opposite sides of the sash to define a plane of sliding movement of the sash, and a pair of pivot members extending oppositely from the sash and defining an axis for pivoting the sash out of the plane of sliding movement, each of said pivot members including a foot portion, normal to the pivot axis, which extends away from the sash and in the plane of the sash and which engages a respective one of said tracks, each of said tracks including an opening for receiving a foot of one of said pivot members during pivoting of the sash out of the plane of sliding movement.

2. The assembly of claim 1 wherein said pivot members define a pivot axis adjacent one edge of the sash.

3. The assembly of claim 2 wherein each of said pivot members includes a leg portion normal to said foot, and means for securing said leg portion to the sash.

4. The assembly of claim 3 wherein said sash includes recesses for receiving the leg portions of said pivot members.

5. The assembly of claim 4 wherein said sash comprises extruded members having walls defining said recess, said walls defining a cross section selected to receive closely the leg portion of said pivot members.

6. The assembly of claim 5 wherein said walls further define a slot along the length thereof, and said means for securing said leg portion includes a tab spanning said slot and a threaded fastener extending through said tab and threaded into said leg portion for drawing said leg portion and said tab together into tight engagement with said walls on opposite sides of said slot.

7. The assembly of claim 2 further including a pair of manually retractable track-engaging pins extending in opposite directions adjacent an edge of the sash opposite from the edge adjacent the pivot axis.

8. The assembly of claim 7 wherein each of said pins includes surface means for facilitating returning the sash to its plane of sliding, said surface means including a beveled surface inclined with respect to the axis of the pins for retracting the pins upon contact between the pins and a respective one of the tracks.

9. The assembly of claim 1 wherein each of said tracks includes a first portion defining a recess through which said feet slide and a second portion, adjacent said first portion, defining a recess through which said feet will not slide.

10. The assembly of claim 9 wherein said second portion of said track is of a length selected to limit the extent of sliding movement of the sash.

11. The assembly of claim 1, said tracks comprising vinyl extrusions.

12. The assembly of claim 1, said tracks comprising extrusions, a guide way means in said extrusions to guide said pivot members and foot in sliding relation along said track, and said opening being located in a side wall of said guide way means to allow a respective foot to rotate into the same.

13. A pivotable and slidable window assembly including a sash, truck means defining a plane of sliding movement for said sash, pivot means connected with said sash and defining an axis of pivoting movement of said sash out of said plane of sliding movement, and stabilizing means for preventing twisting movement of said sash when said sash is pivoted out of said plane of sliding movement; said stabilizing means including (i) a foot connected with said sash, said foot extending normal to said pivot axis and parallel to said plane of sliding movement, and (ii) openings in said track means for receiving said foot upon pivoting of said sash; said foot being adapted to engage portions of the openings to prevent twisting of the sash as said sash is pivoted out of said plane of sliding movement.

14. The assembly of claim 13 wherein said stabilizing means includes two feet connected with said sash, each foot extending normal to said pivot axis and parallel to said plane of sliding movement, said openings being adapted to receive both of said feet upon pivoting of said sash, to prevent twisting of said sash out of said plane of sliding movement.

15. The assembly of claim 14 wherein said pivot axis is adjacent one edge portion of said sash and said feet extend from said axis.

16. The assmebly of claim 14 wherein said feet are slidably received in said track means for sliding movement in said plane.

17. The assembly of claim 16 wherein said track means includes stop means for limiting the extent of sliding movement of said sash.

18. The assembly of claim 17 wherein said stop means includes surface means for abuttingly engaging said feet to prevent further movement of said feet in said track means in one direction.

* * * * *